US006464533B1

(12) United States Patent
Ma et al.

(10) Patent No.: US 6,464,533 B1
(45) Date of Patent: Oct. 15, 2002

(54) MODULAR JACK WITH LED

(75) Inventors: Xuedong Ma; GuangXing Shi, both of Kunsan (CN)

(73) Assignee: Hon Hai Precision Ind. Co., Ltd., TaipeiHsien (TW)

( * ) Notice: Subject to any disclaimer, the term of this patent is extended or adjusted under 35 U.S.C. 154(b) by 0 days.

(21) Appl. No.: 10/053,417

(22) Filed: Nov. 2, 2001

(30) Foreign Application Priority Data

Aug. 31, 2001 (TW) ..... 90215030 U

(51) Int. Cl.[7] ..... H01R 3/00

(52) U.S. Cl. ..... 439/490

(58) Field of Search ..... 439/490, 676, 439/79

(56) References Cited

U.S. PATENT DOCUMENTS 5,601,451 A * 2/1997 Driones et al. ..... 439/490
5,685,737 A * 11/1997 Morin et al. ..... 439/490
5,876,239 A * 3/1999 Morin et al. ..... 439/490
6,325,664 B1 * 12/2001 Someda et al. ..... 439/490

* cited by examiner

*Primary Examiner*—Tho D. Ta
(74) *Attorney, Agent, or Firm*—Wei Te Chung

(57) ABSTRACT

A modular jack (1) includes an insulative housing (10), a plurality of contacts (20) received in the housing, a LED (4) and a tab (40). The insulative housing has a bottom wall (10*b*) defining a first slot (16) and a second slot (18) communicated with the first slot. A post (18*a*) projects from an interior surface of the second slot. The LED comprises an indicator (32) received in the first slot, and a pair of leads (34) extending from the indicator and received in the second slot. The tab is received in the second slot and engaged with the leads. A through hole (42*a*) is defined in the tab for downward extension of the post.

6 Claims, 4 Drawing Sheets

MODULAR JACK WITH LED

BACKGROUND OF THE INVENTION

1. Field of the Invention

The present invention relates to a modular jack, and particularly to a modular jack which retains a pair of Light-Emitting Diodes (LEDs) therein.

2. Description of Related Art

A modular jack, also known as a RJ connector, is commonly used in network and computer peripheral equipment system for the transmission of voice and data. A RJ connector is typically used to form a link between two pieces of equipment to provide a communication means therebetween. In order to ensure the integrity of the link, it has been a practice in the industry to use a LED located separately from the link to provide visual status and fault information regarding the connection. U.S. Pat. No. 6,142,822 commonly assigned to the present assignee discloses a conventional RJ connector having a LED 20, as shown in FIG. 4. A first slot 110 and a second slot 112 having a through hole 116 communicated with the first slot 110 are defined in the top of the housing 1. The LED 20 includes an indicator 22 received in the first slot 110 of the housing 1, and a pair of leads 21 each with one end received in the indicator 22 and with another end passing through the second slot 112 and extending downwardly through guiding groove 114 along a rear wall 14 of the housing 1. A tab 4 is disposed into the second slot 112 to abut a portion of the leads 21 against an interior face of the second slot 112. The tab 4 has an integrally formed guiding rail 44. The guiding rail 44 enters into the through hole 116 and is secured therein. Therefore, the LED 20 is prevented from disengaging the second slot 112. Post 18 is used to assure the connector can be properly positioned on a printed circuit board. However, when it is required that LED 20 and post 18 be both present in the same mounting face, fastening the two will become a problem due to limited space available.

An improved modular jack with both secured LEDs and positioning posts on the same site are thus desired.

SUMMARY OF THE INVENTION

Accordingly, the object of the present invention is to provide a modular jack having fixing means for securing LEDs and for positioning on a printed circuit board.

In order to achieve the object set forth, a modular jack for receiving a plug connector in accordance with the present invention comprises an insulative housing, a plurality of contacts, a pair of LEDs and a pair of tabs. The insulative housing has a bottom wall defining a first slot and a second slot. The first slot communicates with a second slot. A post projects from an interior surface of the second slot in order to facilitate mounting of the modular jack onto a printed circuit board. The LEDs are received in the slots of the housing, and each comprises an indicator received in the first slot and a pair of leads extending rearwardly and downwardly from the indicator. The leads are received in the second slots for connecting the indicator with the printed circuit board. The tab is received in the second slot and engaged with the leads of the LED. Each tab defines a through hole for downward extension of the post and a pair of cut-outs at both sides thereof for downward extension of the leads.

Other objects, advantages and novel features of the invention will become more apparent from the following detailed description when taken in conjunction with the accompanying drawings.

DETAILED DESCRIPTION OF THE INVENTION

Figure 1:
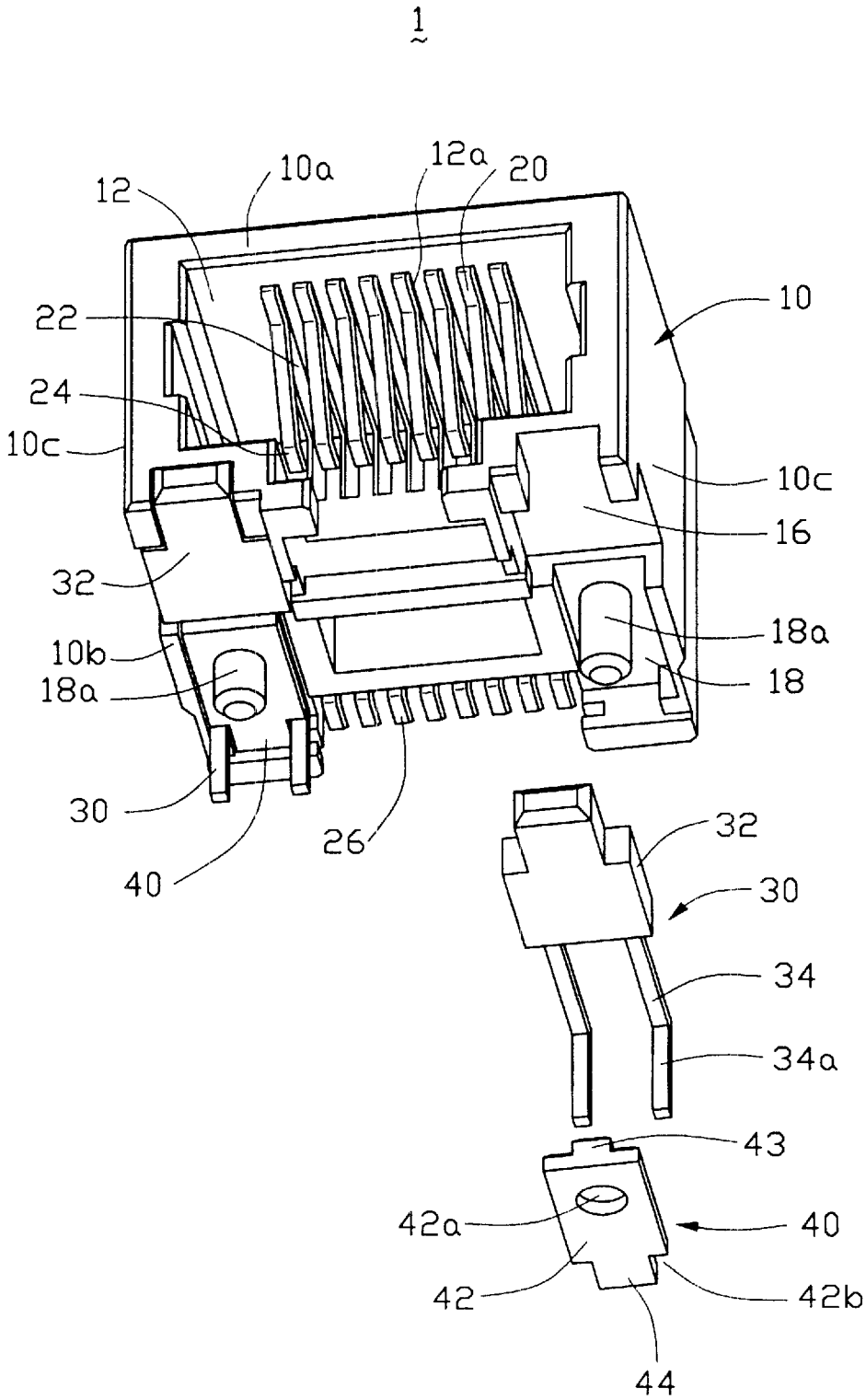
FIG. 1 is a perspective view of a modular jack in accordance with the present invention, with a tab and a LED exploded for clarity.

Reference will now be made to the drawing figures to describe the present invention in detail.

Figure 2:
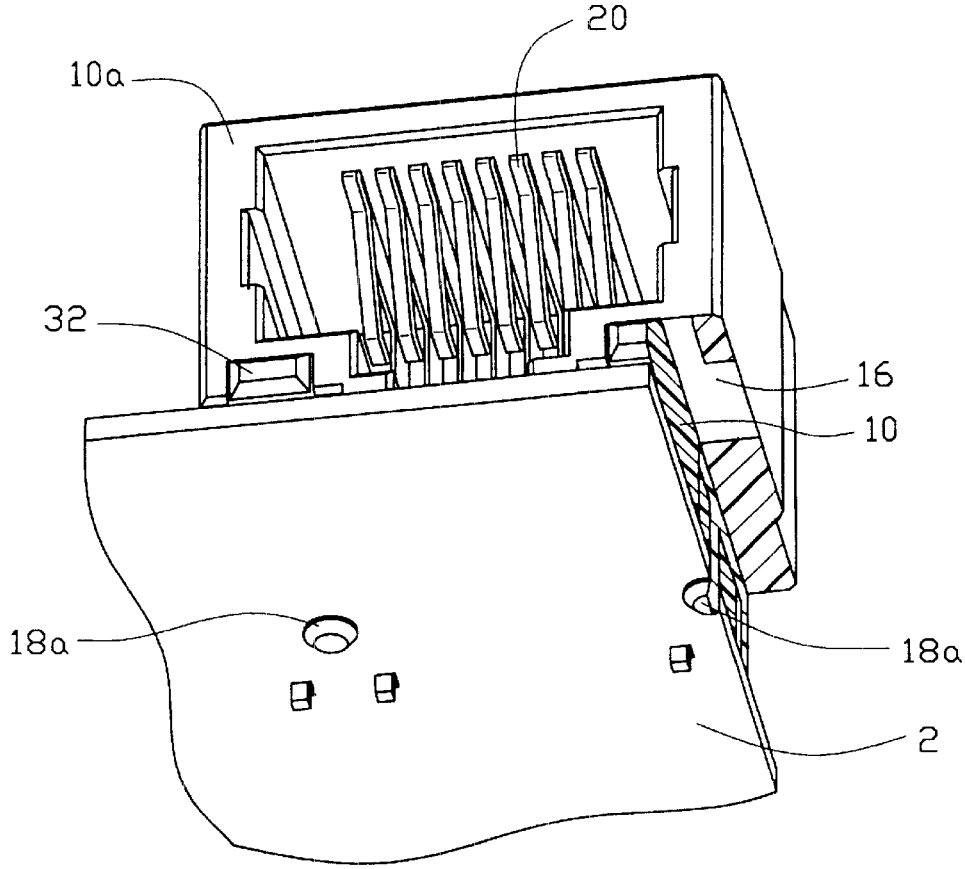
FIG. 2 is a view partially cut away to illustrate the engagement between the modular jack in FIG. 1 and a printed circuit board.
Figure 3:
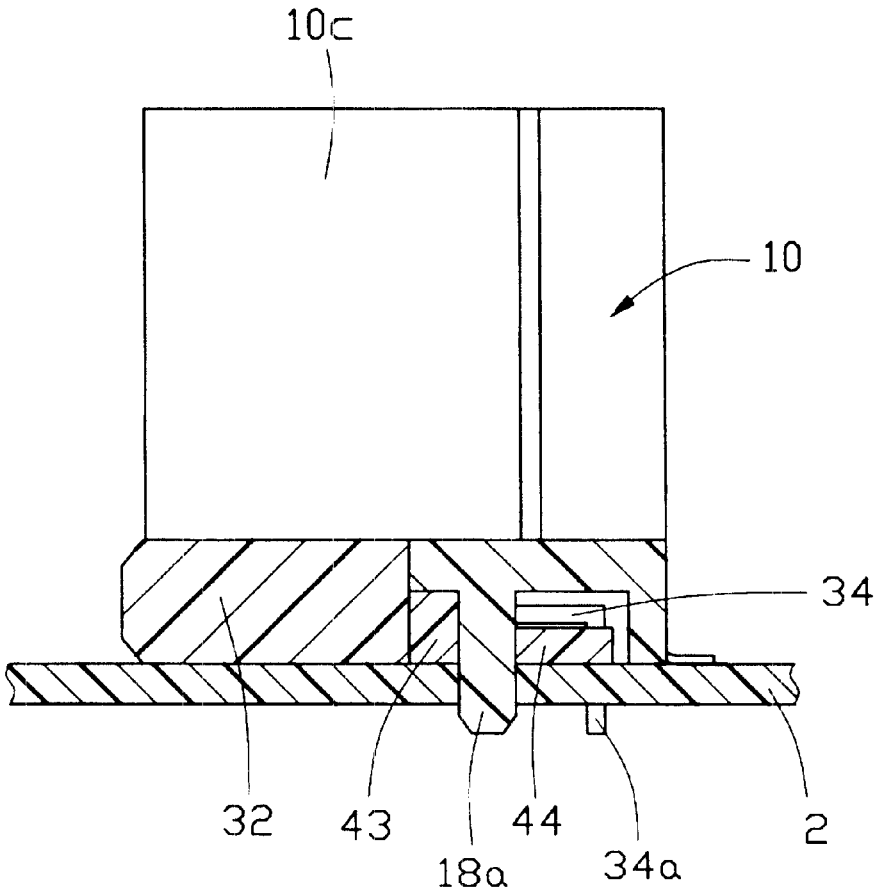
FIG. 3 is a cross sectional view of the modular jack in FIG. 2.
Figure 4:
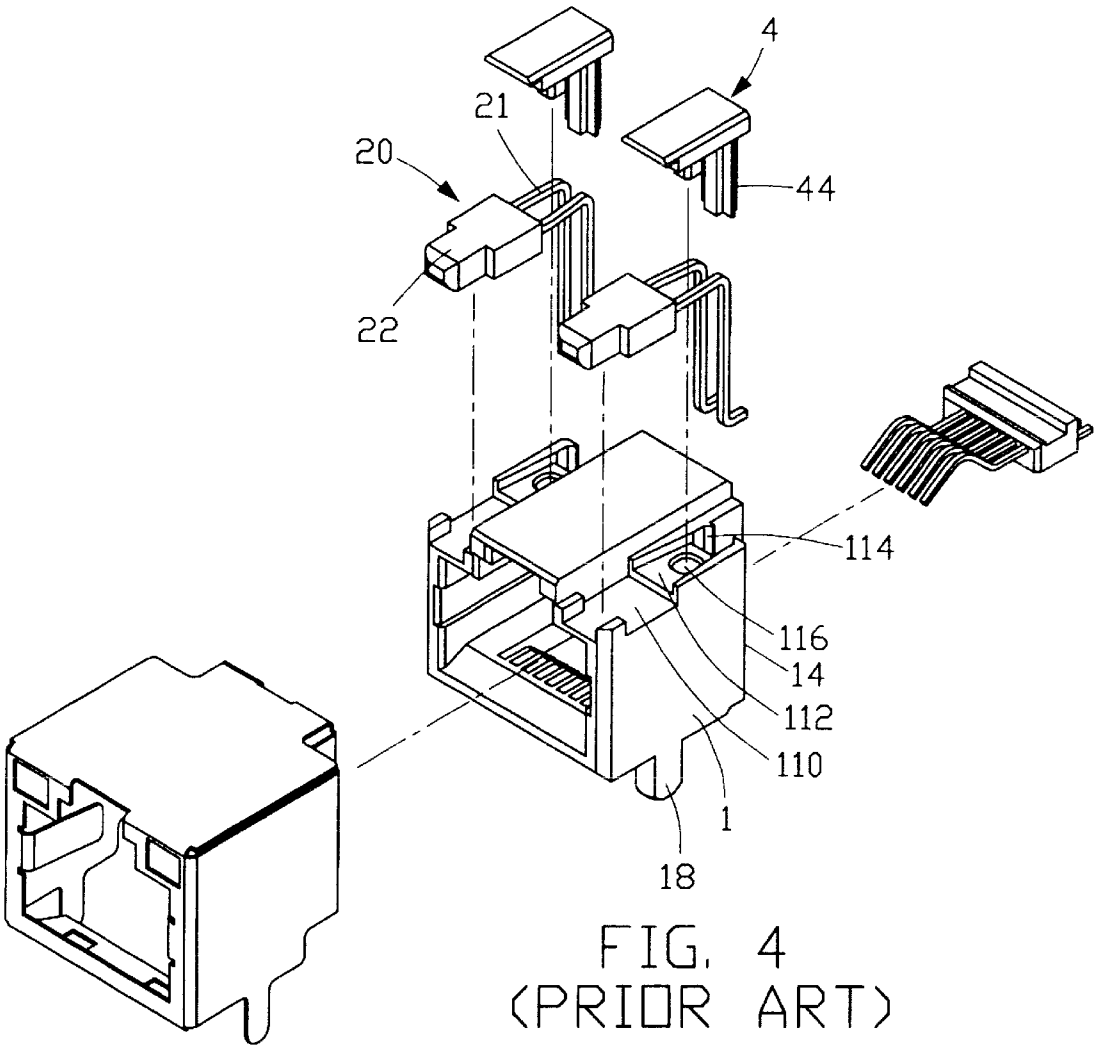
FIG. 4 (PRIOR ART)
FIG. 4 is a perspective view of a prior art modular jack.

Referring to FIGS. 1, 2 and 3, a modular jack 1 of the present invention comprises an insulative housing 10, a plurality of contacts 20 received in the housing 10 for electrically mating with contacts of a mating plug connector (not shown), a pair of LEDs 30 for indicating whether an electrical connection is established or not, and a pair of tabs 40 for securing the LEDs 30.

The insulative housing 10 includes a front wall 10*a* for engaging with the mating plug connector, a bottom wall 10*b* for being mounted on a printed circuit board 2 (shown in FIG. 2), and a pair of sidewalls 10*c*. A receiving cavity 12 is defined in the insulative housing 10 for receiving the plug connector therein. The receiving cavity 12 communicates with a plurality of passageways 12*a*. The bottom wall 10*b* defines a first slot 16 shaped like character "T" and a second slot 18 communicated with the first slot 16. The depth of the second slot 18 is smaller than that of the first slot 16. A post 18*a* projects from an interior surface of the second slot 18 in order to facilitate mounting of the modular jack 1 onto the printed circuit board 2.

The contact 20 includes a fixed portion 22 received in a corresponding passageway 12*a*, a contact end 24 connected with the fixed portion 22 for mating with a contact of the mating plug connector, and a solder tail 26 connected with the fixed portion 22 opposite to the contact end 24 for soldering to the printed circuit board 2.

The LED 30 comprises an indicator 32 retained in the first slot 16 and a pair of conductive leads 34 extending rearwardly from the indicator 32. The pair of leads 34 is accommodated in the second slot 18. Solder tails 34*a* of the leads 34 are bent downwardly for electrically connecting the indicator 32 with the printed circuit board 2.

Each tab 40 includes a base 42 engaged with the second slot 18, a through hole 42*a* disposed in the base 42 for allowing the post 18*a* to pass through, and a pair of cutouts 42*b* defined at two corners of the base 42 so that the solder tails 34*a* of the leads 34 can extend down through the cutouts 42*b* into the printed circuit board 2. Protruding portion 43 extending from a front edge of the base to around the through hole 42*a* projects from a bottom face of the base 42. Rear portion 44 between opposed cutouts 42*b* extends from the rear edge of the base 42. The thickness of protruding portion 43 is bigger than that of rear portion 44 relative to the depth of the first slot and the second slot.

In assembly, the contacts 20 are mounted into the receiving cavity 12 of the housing 10 from the rear, with the solder tails 26 thereof extending rearwardly from the bottom wall

10*b* of the housing 10. The indicator 32 of the LED 30 is fit into the first slot 16, and the leads 34 of the LED 30 pass through the second slot 18. Then post 18*a* aligns with and enters into the through hole 42*a* of the tab 40, and the solder tails 34*a* of the leads 34 go down through the cutouts 42*b* of the tab 40, and then extend beyond the bottom wall 10*b* of the housing 10 for being soldered to the printed circuit board 2. Meanwhile rear portion 44 of the tab 40 is fit into the second slot 18 over the leads 34, protruding portion 43 of the tab 40 abuts against a rear end of the indicator 32 of the LED 30. Therefore, the LED 30 is secured in the housing 10.

Since the through hole 42*a* is provided in the tab 40 to cooperate with the post 18*a* that extends downwardly from the housing 10, a proper positioning is ensured between the modular jack 1 and the printed circuit board 2, even in the presence of LEDs 30 around the post 18*a*.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack mounted on a printed circuit board for mating with a plug connector, comprising:

an insulative housing comprising a front wall, a bottom wall, a receiving cavity defined through the front wall and adapted for receiving a plug connector, and a post projecting downwardly from the bottom wall, the bottom wall having a first slot and a second slot;

a plurality of contacts received in the insulative housing;

a light-emitting diode (LED) comprising an indicator received in the first slot and a pair of leads extending from the indicator; and a tab disposed in said second slot and engaged with the leads of the LED, the tab defining a through hole for downward extension of the post;

wherein the tab has a cutout at each of two rear sides thereof to allow the leads of the LED to pass through.

2. The modular jack as described in claim 1, wherein the first slot communicates with the second slot, the depth of the second slot being smaller than that of the first slot.

3. The modular jack as described in claim 1, wherein the leads of the LED extend through the second slot and beyond the bottom wall of the housing.

4. The modular jack as described in claim 1, wherein the tab abuts against the indicator of the LED.

5. The modular jack as described in claim 1, wherein the tab comprises a base and protruding portion projecting from the base to stand the base off a bottom face of the second slot.

6. An electrical connector assembly comprising:

an insulative housing;

a plurality of contacts received within the housing;

at least a slot formed around a corner of a bottom portion of the housing, said slot extending along a front-to-back direction;

a post downwardly extending from an interior surface of said slot;

an LED disposed in the bottom portion with a pair of leads seated within the slot; and a holding tab fit within the slot under said pair of leads to hold the leads in position; wherein said holding tab includes a through hole, through which the post extends for mounting to a printed circuit board under the housing.

* * * * *